United States Patent [19]

Hara

[11] Patent Number: 5,005,831

[45] Date of Patent: Apr. 9, 1991

[54] ATHLETIC EQUIPMENT FOR REHABILITATION

[76] Inventor: Tsutomu Hara, 20-15, Kamisoshigaya 3-chome, Setagaya-ku, Tokyo, Japan

[21] Appl. No.: 226,543

[22] Filed: Aug. 1, 1988

[51] Int. Cl.[5] ..... A63B 21/04

[52] U.S. Cl. ..... 272/136; 272/93

[58] Field of Search ..... 272/93, 67, 68, 116, 272/900, 901, 143, 118, 135, 136, 142, 134; 128/25 R

[56] References Cited

U.S. PATENT DOCUMENTS

| | | | |
|---|---|---|---|
| 4,563,003 | 1/1986 | Bogallo et al. | 272/134 X |
| 4,585,363 | 4/1986 | McGuire | 272/67 X |
| 4,592,545 | 6/1986 | Sagedahl | 272/136 X |
| 4,669,451 | 6/1987 | Blauth et al. | 128/78 X |
| 4,807,871 | 2/1989 | Bryson | 272/134 X |

FOREIGN PATENT DOCUMENTS

| | | | |
|---|---|---|---|
| 1280471 | 10/1968 | Fed. Rep. of Germany | 128/87 R |

*Primary Examiner*—Richard J. Apley
*Assistant Examiner*—H. Flaxman
*Attorney, Agent, or Firm*—Lowe, Price, LeBlanc, Becker & Shur

[57] ABSTRACT

Athletic equipment for rehabilitation comprises a support fixture and a first arm pivotally mounted to the support fixture. The first arm is further mounted to the fixture for rotation in a direction different from the direction of pivotable movement. A second arm is rotatably coupled to the first arm. At least one holder, graspable by a user to pivot and/or rotate at least one of the first and second arms in exercising movement, is mounted on the second arm. A spring and balancing cam mechanism supported on the fixture is operable to transmit substantially constant spring force bias to the holder during pivotable movement of the first arm.

19 Claims, 1 Drawing Sheet

ATHLETIC EQUIPMENT FOR REHABILITATION

BACKGROUND OF THE INVENTION

The present invention relates to improved athletic equipment for rehabilitation.

Conventional athletic equipment for rehabilitation may be of a type wherein a user moves up and down on holders, are coupled to a spring or a counterweight, and on which holders he rests his limbs, for up-and-down exercise of limbs to enhance corresponding muscles. Also, different types of equipment are known in which the user grasps holders arranged to be slidable along rails provided in on a ceiling, or grasps parallel rods disposed at the same height from each other, for walking exercise or the like. However, conventional equipment has only a single function, such as one solely for up-and-down exercise, or a walking exercise. As a consequence, in order to perform various kins of exercise or training, various types of equipment are required therefor.

SUMMARY OF THE INVENTION

In consideration of the drawback of conventional athletic equipment for rehabilitation such that they merely provide a single function, the object of the present invention is to provide athletic equipment for rehabilitation, which is simple in construction and easy in use, having limb holders which permit complicated three-dimensional exercise including vertical, rotational, and back-and-forth motions, so as to enable a user to perform various kinds of rehabilitation exercise such as ones for enhancement of limb muscles, and for bending, stretching and rotation of limbs. To achieve the above-mentioned object, according to the present invention, a first arm, arranged to be vertically pivotable against balanced spring bias, is coupled to a fixture, for horizontal rotation, and a second arm, horizontally pivotably coupled to the first arm and arranged to be axially telescopic, is provided at its tip end with holders.

A balancing cam, fixed to an end portion of the first arm, is pivotably mounted on a spring case, and the spring has an upper end attached to the spring case and a lower end coupled to a portion of the balancing cam through a wire. The balancing cam is formed to support the wire at a fulcrum which assumes a position away from a rotary shaft of the balancing cam when the spring is compressed, the fulcrum assuming a different position close to the rotary shaft when the spring is extended.

The wire is wound around a pulley, and an upper end of the spring is connected to a load adjustment bolt which is threadedly inserted into a female screw which is rotatably mounted on the spring case.

The fixture comprises a tubular member into which a lower portion of the spring case is inserted, and the fixture is provided with a clamping screw for preventing said spring case from rotating. A clamping member mounts the fixture on a table.

The first arm has a tip end rotatably mounted on a tubular support member, and an arm disposed in parallel with the first arm has opposite ends which are rotatably mounted on the spring case and the tubular supporting member, respectively. The first arm cooperates with the parallel arm, spring case and tubular supporting member to form a parallel linkage. A stopper for defining upper and lower limits of vertical motion of the tubular support member removably provided with a counterweight, is provided at at least one of mounting portions at which the parallel arm is mounted on the spring case and the tubular support member, respectively.

The second arm is provided with a clamping screw for fixing a slide arm which is slidably disposed within the second arm. A holder mounting member is mounted on a tip end of the second arm for horizontal rotation, and the holder is mounted on the holder mounting member.

The holder mounting member is formed with two holes through which holder position adjusting rods are slidably inserted, and first and second holders are attached to these rods. The holder mounting member is provided with clamping screws, corresponding to these two holes, for holding the rods in position.

DETAILED DESCRIPTION

Figure 1:
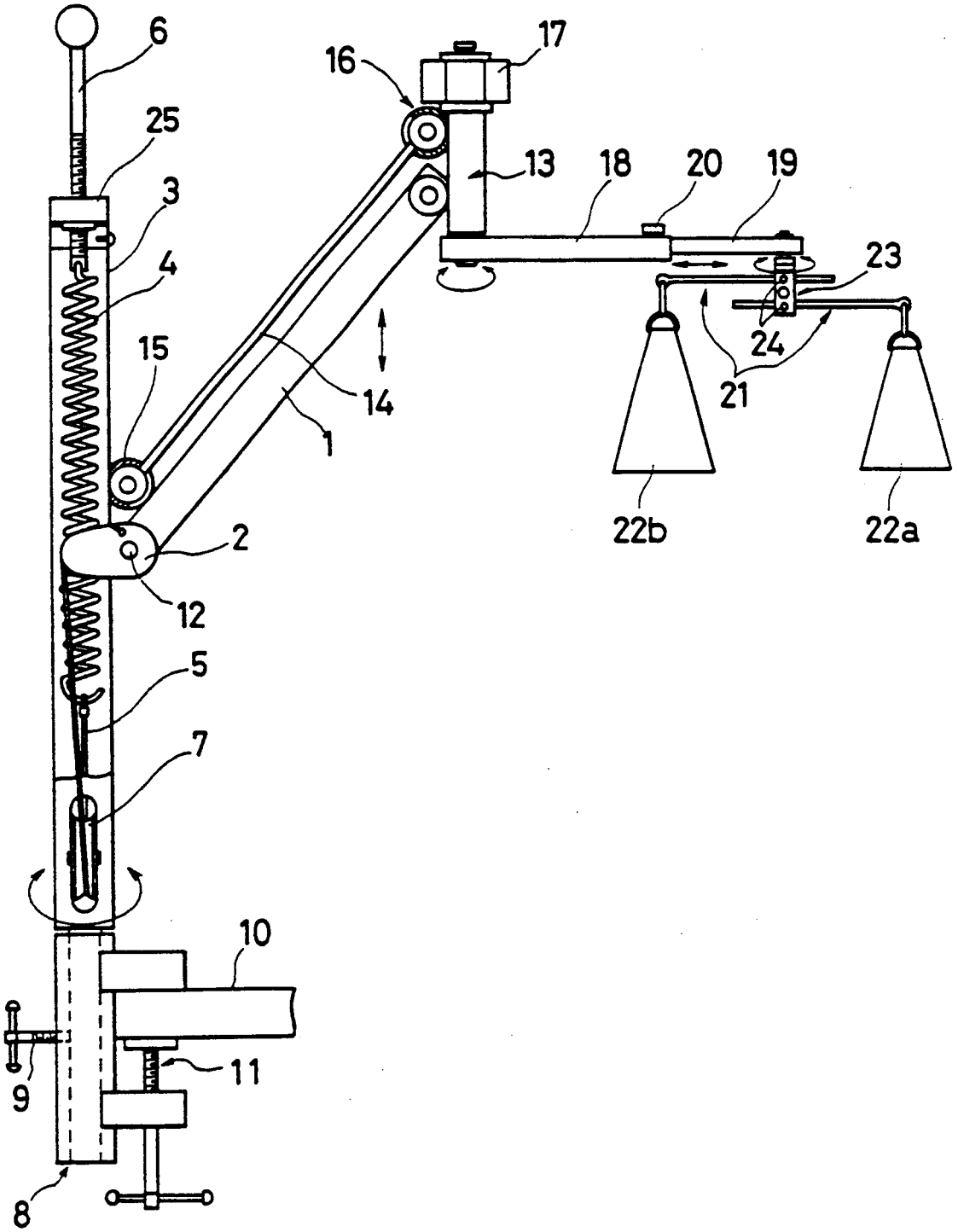
FIG. 1 is a front view of an embodiment of the present invention, with an essential part illustrated in cross section.

In FIG. 1, a first arm 1 has a balancing cam 2 fixed at one end thereof. The cam 2 is mounted on a spring case 3 for rotation around a shaft 12. A coil spring 4 disposed in the spring case 3 has a lower end coupled to a portion of the balancing cam 2 through a wire 5. In this manner, the first arm 1 is arranged to be pivotable in a vertical direction, with the aid of the coil spring 4. This spring 4 has an upper end coupled to a lower end of a load adjustment bolt 6 which is disposed at an upper end of the spring case 3, so that the upper end of the spring 4 is moved vertically, with rotation of a female screw member 25 threadedly engaged with the bolt 6 disposed at the upper end of the case 3. A pulley 11 is disposed within the spring case 3 for smooth movement of the wire 5 wound around the pulley 7.

A lower portion of the spring case 3 is received in a fixture including a stationary tubular member 8 for horizontal rotation, and is fixed to the tubular member 8 by means of a clamping screw 9 provided in the member 8. Further, the stationary tubular member 8 is provided with a clamping member 11 for mounting the member 8 to a table 10 or the like. That is, the first arm 1 is arranged for horizontal rotation relative to the stationary tubular member 8.

The balancing cam 2 is formed into a shape such that it supports the wire 5 at a fulcrum which assumes a position away from the rotary shaft 12 when a tip end of the first arm 1 is located at an upper vertical position, with the coil spring 4 compressed, the fulcrum assuming different positions closer to the shaft 12 as the tip end of the arm 1 is moved downwardly. Accordingly, a force generated by the coil spring 4, which balances with a force acting downwardly on the tip end of the first arm 1, is always kept constant.

The tip end of the first arm 1 is attached to a tubular support member 13 which extends vertically, and opposite ends of an arm 14, extending in parallel with the first arm 1, are pivotably attached to the spring case 3 and the tubular support member 13, respectively. The first arm 1 cooperates with parallel arm 14, spring case 3 and tubular member 13 to form a parallel linkage, so that the member 13 is always moved only in a vertically upright manner. Moreover, stoppers 15, 16 are provided at at least one of the mounting portions of the parallel arm 14 at which the arm is mounted on the spring case 3 and the tubular supporting member 13, for defining upper and lower limits of vertical motion of the tubular support member 13.

A cylindrical counterweight 17 is removably mounted on an upper end portion of the tubular supporting member 13, and one end of a second arm 18 is coupled to a lower end of the member 13 for horizontal rotation, so that the second arm 18 is horizontally rotatable relative to the first arm 1. The second arm 18 has a slide arm 19 which is slidably disposed within the arm 18, and is thus axially telescopic. The slide arm 19 is adapted to be held in position by means of a clamping screw 20 provided in the second arm 18. Horizontally rotatably mounted on a tip end portion of the slide arm 19 is a holder mounting member 23 which is formed with two holes through which two holder position adjusting rods 21 are slidably inserted, respectively, Moreover, the holder mounting member 23 is provided with clamping screws 24 for holding these rods 21 in position in the holes. First and second holders **22*a* and 22*b*, arranged to receive hands or feet of a user, are fixed to the holder position adjusting rods 21**, respectively.

The present invention constructed as mentioned above operates as follows When the user wishes to effect training for enhancing his limb muscles by moving hands or feet up and down, the user fixes the spring case 3 to the stationary tubular member 8 by means of the clamping screw 9 provided in the member 8. Then, after releasing the stoppers 15 and 16 of the parallel arm 14, the user rotates the female screw member 25 to move the load adjusting bolt 6 in the vertical direction to regulate the force of the coil spring 4. Thereafter, he inserts his hands or feet into the first and second holders **22*a*, 22*b*, respectively, and then moves these holders up and down. During such exercise, the tension force generated by the coil spring 4 provides a constant load through the balancing cam 21**, so that the user always moves his hands or feet up and down against a constant force, and is thus permitted to effect exercise for enhancement of limb muscles.

Further, when the user moves his hands or feet inserted into the holders **22*a* and 22*b* to left and right, the second arm 18 is caused to rotate around the tubular support member 13, to permit such exercise. Moreover, if the clamping screw 20 provided in the second arm 18 is loosened, the slide arm 19 is permitted to slide within the second arm 18**. As a result, a complicated exercise of limbs, including back-and-forth motion as well as left-and-right motion, can be achieved.

If the user loosens the clamping screw 9 so that the spring case 3 is rotatable relative to the stationary tubular member 8 so as to permit a horizontal rotary motion of the spring case 3 with respect to the tubular member 8, a more complicated exercise can be followed. In addition, the present invention permits various training including other exercises for enhancement of abdominal and back muscles, for instance, and hence serves as a suitable athletic equipment for rehabilitation.

What is claimed is:

1. Athletic equipment for rehabilitation, comprising:

a support means adapted to be mounted to a supporting surface;

a first arm pivotally mounted to the support means for pivotable movement in a first direction and means for mounting said first arm and said support means to said support surface for co-rotation of the first arm and support means in a second direction different from the first direction of pivotal movement;

a second arm coupled to said first arm so as to be capable of rotation in a plane oblique to the plane containing the first arm; and at least one holder, graspable by a user to pivot and/or rotate at least one of the first and second arms in exercising movement, mounted on said second arm; and means for imparting spring bias to the holder during pivotal movement of the first arm.

2. Athletic equipment for rehabilitation according to claim 1, wherein said support means includes a spring case and said spring means is mounted to the case and connected to the first arm to impart spring bias to the holder during pivotal movement of the first arm, and further including a balancing cam fixed to one end of said first arm and rotatably mounted to the spring case with a rotatable shaft to which case an upper end of said spring means is connected, a wire for coupling a lower end of the spring means to a portion of the balancing cam, said balancing cam being formed such that said cam supports said wire at a fulcrum location which assumes a position away from a rotary shaft of said balancing cam when said spring is compressed, the fulcrum assuming a different position closer to said rotary shaft when said spring means is extended.

3. Athletic equipment for rehabilitation according to claim 2, further including a pulley around which a portion of said wire located between the spring means and cam is wound.

4. An athletic equipment for rehabilitation according to claim 2, wherein said spring means has an upper end connected to a load adjustment bolt, said bolt being threadedly inserted into a female screw which is rotatably mounted on the spring case.

5. Athletic equipment for rehabilitation according to claim 2, wherein said support means further includes a support fixture including a tubular member into which a lower portion of the spring case in inserted. spring case inserted.

6. An Athletic equipment for rehabilitation according to claim 2, wherein said support means is provided with a clamping screw for preventing said spring case from rotating.

7. An Athletic equipment for rehabilitation according to claim 1, wherein said support means is provided with a clamping member for mounting said equipment on a table.

8. Athletic equipment for rehabilitation according to claim 2, wherein said first arm has a tip end rotatably mounted on a tubular support member, and further including another arm disposed substantially parallel with the first arm said another arm having opposite ends rotatably mounted on the spring case and the tubular supporting member, respectively, said first arm cooperating with said another arm, and said spring case and said tubular supporting member to form a parallel linkage.

9. Athletic equipment for rehabilitation according to claim 8, further including a stopper for defining upper and lower limits of vertical motion of said tubular support member, said stopper provided at at least one of mounting portions at which said another arm is mounted on said spring case and said tabular support member, respectively.

10. An Athletic equipment for rehabilitation according to claim 8, wherein said tubular support member is removably provided with a counterweight.

11. An Athletic equipment for rehabilitation according to claim 1, wherein said second arm is provided with a clamping screw for fixing a slide arm which is slidably telescopically disposed within said second arm.

12. An Athletic equipment of rehabilitation according to claim 1, wherein a holder mounting member is mounted on a tip end of said second arm for horizontal rotation, and said holder is mounted on said holder mounting member.

13. An Athletic equipment for rehabilitation according to claim 12, wherein said holder mounting member is formed with two holes through which holder position adjusting rods are slidably inserted, and first and second holders are attached to said holder position adjusting rods.

14. An Athletic equipment for rehabilitation according to claim 13, wherein said holder mounting member is provided with clamping screws, corresponding to said two holes, for holding said holder position adjusting rods in position.

15. Athletic equipment according to claim 2, wherein said balancing cam and adjustable fulcrum serve to transmit substantially constant spring force bias to the holder during pivotable movement of the first arm.

16. Athletic equipment according to claim 15, wherein said first arm is pivotally movable in a vertical plane and rotatable in a horizontal plane when said support fixture is positioned in a vertically upright manner.

17. Athletic equipment according to claim 16, wherein said second arm is telescopic and horizontally rotatable.

18. Athletic equipment according to claim 1, wherein said second arm is rotatably coupled to the first arm.

19. Athletic equipment for rehabilitation, comprising a support means adapted to be mounted to a supporting surface; a first arm pivotally mounted to the support means for pivotal movement in a first direction; a second arm coupled to said first arm so as to be capable of rotation in a direction different from the first direction of pivotal movement; and at least one holder, graspable by user to pivot and/or rotate at least one of the first and second arms in exercising movement, mounted on said second arm; wherein said support means includes a spring case and spring means mounted to the case and connected to the first arm to impart spring bias to the holder during pivotal movement of the first arm, and further including a balancing cam fixed to one end of the said first arm and rotatably mounted to the spring case with a rotatable shaft to which case an upper end of said spring means is connected, a wire for coupling a lower end of the spring means to a portion of the balancing cam, said balancing cam being formed such that said cam supports said wire at a fulcrum location which assumes a position away from a rotary shaft of said balancing cam when said spring is compressed, the fulcrum assuming a different position closer to said rotary shaft when said spring means is extended.

* * * * *